United States Patent [19]

Hix

[11] 3,994,338

[45] Nov. 30, 1976

[54] HYDROSTATIC PRESSURE RELEASE FOR BOTTOM HOLE OIL WELL PUMPS

[76] Inventor: Richard E. Hix, 219 S. Locust, Pauls Valley, Okla. 73075

[22] Filed: Nov. 17, 1975

[21] Appl. No.: 632,880

[52] U.S. Cl. ..... 166/105; 166/317; 417/434

[51] Int. Cl.[2] ..... E21B 43/00

[58] Field of Search ..... 166/224, 208, 105; 417/434, 446; 175/320

[56] References Cited

UNITED STATES PATENTS

| | | | |
|---|---|---|---|
| 3,366,182 | 1/1968 | Solum | 166/208 |
| 3,417,822 | 12/1968 | Howell | 175/320 |
| 3,448,805 | 6/1969 | Brown | 417/434 |

*Primary Examiner*—James A. Leppink
*Attorney, Agent, or Firm*—Robert K. Rhea

[57] ABSTRACT

A subjoint, having a wall port normally closed by a frangible disk, is connected with the depending end of a bottom hole oil well pump below the standing valve for draining fluid out of the tubing when the frangible disk is ruptured.

3 Claims, 3 Drawing Figures

HYDROSTATIC PRESSURE RELEASE FOR BOTTOM HOLE OIL WELL PUMPS

BACKGROUND OF THE INVENTION

1. Field of the Invention

The present invention relates to oil well pumping equipment and more particularly to a means for releasing the hydrostatic pressure contained by the tubing.

Oil well pumping equipment includes a string of tubing in a borehole having a vertically reciprocating fluid pump in its depending end portion operated by sucker rods. Some oil producing formations contain sand or other abrasive material which wears the pump components necessitating replacement of the pump by pulling the sucker rods and pump. Sometimes on account of equipment malfunction, sand sticking the pump or for other reasons the pump anchor hold down body cannot be separated from the anchor hold down shoe at the depending end of the tubing. This requires pulling the tubing and the sucker rods simultaneously and is known as a "stripping job" wherein oil within the tubing is wasted as each joint of tubing is disconnected at the surface of the earth besides creating a hazardous condition for workmen. Furthermore, the increased mass of the pumping string, as a result of the tubing contained fluid, requires the use of a heavy duty pulling unit and additional fuel for its operation.

2. Description of the Prior Art

Frangible disks closing a port in the wall of a tube in oil wells, and the like, are well known, however, these frangible disks have generally comprised a means for releasing valves or plugs for closing the bore of the tube to permit reverse circulation.

This invention provides a subjoint containing a port closed by a frangible disk disposed below the oil well pump which, when the disk is ruptured, drains oil out of the tubing into the borehole.

SUMMARY OF THE INVENTION

A tubular subjoint is connected with the depending end of a tubing contained bottom hole pump below the standing valve and above the pump hold down and forms a part of the fluid passageway between the pump and the pump hold down. The subjoint is provided with a port in its wall normally closed by a frangible disk. The frangible disk is ruptured when desired by increasing the pressure of the fluid contained by the tubing thus permitting the fluid to drain out of the tubing into the borehole for pulling the pump and/or tubing. A left hand threaded tube is interposed between the subjoint and the pump hold down for releasing the pump in the event the fragible disk cannot be ruptured.

The principal objects of this invention are to provide a frangible disk type hydrostatic head release tubular sub for an oil well pump contained by a tubing string and to provide a left hand threaded tube for releasing the pump and the hydrostatic head in the event the frangible disk cannot be ruptured.

DESCRIPTION OF THE PREFERRED EMBODIMENT

Figure 2:
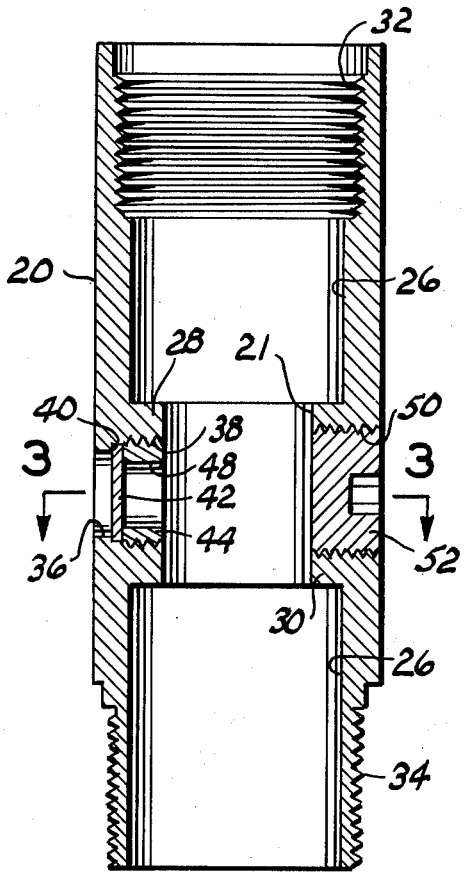
FIG. 2 is a vertical cross sectional view, to a larger scale, of the frangible disk containing subjoint, per se; and, FIG. 3 is a horizontal sectional view taken substantially along the line 3—3 of FIG. 2.
Figure 3:
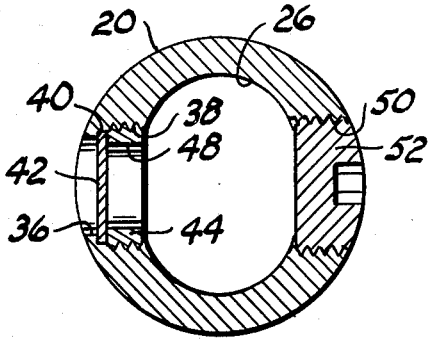
Figure 1:
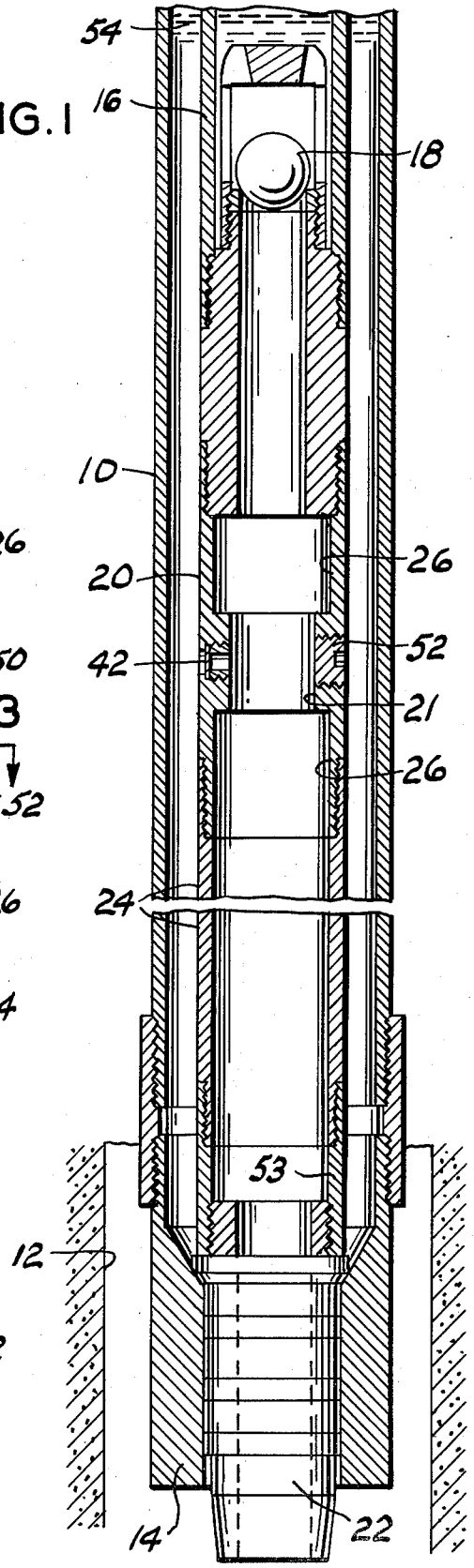
FIG. 1 is a fragmentary vertical cross sectional view of the depending end portion of pumping equipment within an oil well.

Like characters of reference designate like parts in those figures of the drawings in which they occur.

In the drawings:

The reference numeral 10 indicates the depending end portion of a tubing string disposed within an oil well borehole 12 and having an anchor hold down shoe 14 at its depending end. The borehole also contains casing, not shown. A conventional bottom hole pump 16, having valve and cage means forming a standing valve 18 connected with its depending end portion, is disposed within the tubing 10.

The numeral 20 indicates a subjoint which is threadedly connected with the depending end of the pump 16. The depending end of the subjoint 20 is connected with an anchor hold down body 22 by a tube 24 in the manner presently explained. The valve of the valve and cage means prevents fluid in the tubing above the pump from re-entering the pump intake fluid passageway defined by the subjoint 20 and the tube 24 as is well understood by those skilled in the art.

The subjoint 20 has a central bore 21 and is counterbored from its respective ends, as at 26, to form opposing thickened wall portions 28 and 30 intermediate its ends. The upper and lower ends of the subjoint are threaded, as at 32 and 34. The wall portion 28 is provided with a port 36 which is counterbored and threaded from its inner end, as at 38, to form an annular inwardly facing shoulder 40 to form a seat for a frangible disk 42. A ring 44, threadedly engaged with the port counterbore threads 38, locks the frangible disk 42 in place. The inside wall 48 of the ring 44, in cooperation with the port 36, forms a fluid passageway, when the disk 42 is ruptured, having a diameter preferably not less than one-fourth inch (0.635cm). The opposite thickened wall portion 30 is bored and threaded, as at 50, coaxial with and diametrically greater than the port 36 for access in installing or replacing the frangible disk 42. The threaded bore 50 is closed by a plug 52.

The depending end portion of the tube 24 is provided with left hand threads cooperatively received by a collar 53 connecting the tube 24 to the anchor hold down body 22. During normal pumping operation the tubing 10 is maintained filled with oil 54.

OPERATION

In operation, the subjoint 20 and tube 24 are connected with the pump 16 and anchor hold down body 22, as described hereinabove, and lowered into the tubing 10 by sucker rods, not shown, connected with the upper end of the pump. The yield point of the frangible disk 42 is chosen in accordance with the particular well in which it is placed. For example, since the weight of the fluid is a constant and the depth of the borehole known the hydrostatic head is calculated and a safety factor of 1,000 pounds (453.6 Kilograms) is added obtaining the fluid pressure reading necessary to rupture the disk 42. In the event it is desired to repair or replace the pump, and the pump anchor hold down body cannot be released from the hold down anchor shoe, additional fluid is injected into the upper end of the tubing at the earth's surface, not shown, to increase the fluid pressure differential across the wall of the subjoint to and rupture the frangible disk. This permits the fluid to drain out of the tubing into casing and the well bore 12 and equalizes the hydrostatic head in the depending end portion of the casing, the borehole and the tubing which prevents loss of the oil producing formation gas pressure. Equalizing the fluid pressure removes the hydrostatic head from the pump and usually allows the pump to be released from the anchor shoe. However if the pump remains stuck the tubing and rods may be simultaneously pulled without the disadvantage of the tubing containing fluid.

In the event the frangible disk cannot be ruptured, as for example, by a leak in the tubing string, preventing fluid pressure build-up to a value exceeding the yield point of the frangible disk, the sucker rods may be rotated to the right in a thread tightening action of the sucker rods so that the left hand threads, at the depending end of the tube 24, are unscrewed from the collar 53 thus permitting the pump to be pulled out of the tubing.

Obviously the invention is susceptible to changes or alterations without defeating its practicability. Therefore, I do not wish to be confined to the preferred embodiment shown in the drawings and described herein.

I claim:

1. In combination with oil well downhole pumping equipment including a string of tubing having a hold down means at its depending end and having a pump disposed within the tubing and secured to the hold down means and forming a pump intake fluid passageway within the annular fluid area of the depending end portion of the tubing, the improvement comprising:

a subjoint interposed between said pump and said hold down means and forming a continuation of said fluid passageway, said subjoint having a port in its wall providing communication between the intake fluid passageway and the tubing annular fluid area; and, frangible disk means normally closing the subjoint port.

2. The combination according to claim 1 in which the subjoint wall around the port is characterized by a counterbore forming an annular shoulder facing inwardly toward the longitudinal axis of the intake fluid passageway and said frangible disk means includes:

a metallic disk, adapted to rupture in response to a predetermined pressure differential across the wall of the subjoint, seated on the annular shoulder; and, a ring maintaining said disk within the counterbore.

3. The combination according to claim 1 and further including:

a tube interposed between said subjoint and the tubing hold down means, said tube having left hand threads at its depending end.

* * * * *